United States Patent [19]

Rogelja

[11] Patent Number: 4,596,314

[45] Date of Patent: Jun. 24, 1986

[54] DESCENDER

[76] Inventor: Boris Rogelja, 20 Spalding Crescent, Hurstville, New South Wales, Australia

[21] Appl. No.: 619,955

[22] Filed: Jun. 12, 1984

[30] Foreign Application Priority Data

Jul. 22, 1983 [AU] Australia ..... PG0437

[51] Int. Cl.[4] ..... A63B 29/00

[52] U.S. Cl. ..... 188/65.5; 182/5

[58] Field of Search ..... 188/65.4, 65.5; 182/5, 182/6, 7, 192, 193

[56] References Cited

U.S. PATENT DOCUMENTS

| | | | |
|---|---|---|---|
| 269,268 | 12/1882 | Davis | 188/65.4 X |
| 311,039 | 1/1885 | Scheidt et al. | 188/65.4 X |
| 3,814,210 | 6/1974 | Hoffman | 182/7 X |

FOREIGN PATENT DOCUMENTS

| | | | |
|---|---|---|---|
| 132592 | 2/1985 | European Pat. Off. | 182/5 |
| 2439678 | 3/1976 | Fed. Rep. of Germany . | |
| 2451752 | 10/1980 | France . | |
| 2024912 | 1/1980 | United Kingdom | 188/65.5 |

*Primary Examiner*—Bruce H. Stoner, Jr.
*Assistant Examiner*—Richard R. Diefendorf
*Attorney, Agent, or Firm*—Millen & White

[57] ABSTRACT

A descender for use when sliding down a rope during an abseil, the descender including a self acting brake mechanism, which will slow the rate of decent unless the brake is held in the release position. The descender has a fixed braking surface and a pair of sheaves mounted on a support member which is pivotable about an axis passing through a lower one of the sheaves such that a rope passing around the lower sheave, between the two sheaves, around the upper sheave and finally between the upper sheave and the braking surface, will cause the pivotable member to be pivoted to press the rope between the upper sheave and the braking surface when a tension is applied to the upper end of the rope. The descender is also provided with a handle to reduce the braking force by pivoting the upper sheave away from the braking surface and a retaining plate pivotable between a position in which a rope is retained in the descender and a position in which the rope is able to be inserted into and removed from the descender.

13 Claims, 8 Drawing Figures

DESCENDER

BACKGROUND OF THE INVENTION

1. Field of the Invention

The present invention relates to "descenders" for use in a abseils and in particular to an improved descender of the type which incorporates a self acting brake.

2. Technical Considerations and Prior Art

Abseils is a technique used to descend steep surfaces, such as cliff faces, and is often used by persons involved in activities such as mountain climbing, canyoning and caving. In order to abseil down a cliff face, one end of a rope is made fast at the top of the cliff and the person making the descent then slides down the rope. The rope is passed either around the body of the person or more usually through a descender attached to a harness worn by the person, such that the passage of the rope around the body or through the descender provides sufficient friction to slow the rate of descent to a safe speed. A descender comprises rope engaging surfaces over which the rope travels to provide frictional engagement between the rope and the descender. The rate of descent is normally controlled by holding the free end of the rope to control the tension on the rope where it enters the descender, and thereby to control the degree of frictional engagement between the rope and the descender which in turn controls the rate of descent.

Descenders used in an abseil vary greatly in performance and complexity, there being a variety of relatively simple devices which rely on frictional engagement between the rope and metal rings or racks about which the rope is wrapped and a number of more complex descenders which incorporate a braking mechanism, thereby enabling the friction between the rope and the descender to be varied. The earliest of these more complex devices had a handle or lever which when operated tended to increase the friction between the descender and the rope, however, this type of descender was not a great improvement over the more simple devices, as the brake was not self engaging, and therefore if the user was knocked unconscious he would fall in the same way as the user of the earlier devices.

The present invention belongs to a class of descenders wherein the variable braking action of the descender increases when the handle is released. Usually the force required to initiate the braking action is provided by the frictional engagement of the descender with the rope travelling therethrough, however, it is also possible to have arrangements which are operated by springs. Spring operated arrangements have the disadvantage that the restoring force of the spring may reduce with age or the spring may become damaged without this being noticed by the user, thereby decreasing the effectiveness of the descender.

All of the prior art descenders incorporating non-sprung self-engaging braking suffer from the problem that the maximum friction achieved by the descender when the brake actuates itself is not always sufficient to completely stop a person who is falling, such as when the person has been knocked unconscious. Examples of such prior art descenders may be studied in French Patent Publication Nos. 2,394,303, 2,430,388, 2,451,752 and 2,478,475 in the names Paul and Pierre Petzl, and West German Patent Publication No. 2,439,678 in the name Wolfgang Siersch. Examples of other lowering devices and rope brakes are described in U.S. Pat. No. 1,370,306 in the name H. J. Griest, U.S. Pat. No. 933,685 in the name J. H. Wray, British Pat. No. 1,125,774 in the name Marcel Jules Odilon Lobelle and British Pat. No. 1,568,614 in the name CATU SA, however, none of these prior art devices provide the simplicity of construction or operation which is achieved with the descender of the present invention.

SUMMARY OF THE INVENTION

The present invention consists in a descender for use in abseil, comprising a pair of rope engaging projections extending perpendicularly from a member which is pivotably mounted on a base having means for connection to a harness, said mounting being pivotable about an axis passing perpendicularly through said member and a first one of said projections being disposed about said axis, a braking surface projecting from said base and located adjacent to the second of said pair of projections such that a rope passing around the first projection, between said pair of projections, around the second projection and between the second projection and the braking surface will be pressed between the second projection and the braking surface when the second projection is pivoted toward the braking surface, said pivotal member including handle means extending from said pivotal axis in a plane substantially perpendicular thereto.

Preferably an embodiment of the invention will also include retention means adapted to prevent a rope which is passing through the descender from jumping out during the descent.

The rope engaging projections will preferably be of sufficient mass to enable a high degree of heat storage before the temperature rise becomes unacceptable. In this regard the temperature of the rope engaging proections will reach an unacceptable level when they approach the softening temperature of the material from which the rope is made.

The retention means should also be adapted to allow the rope to be inserted and removed easily when hooking up before the descent and when unhooking after the descent.

All rope engaging surfaces of the descender are preferably smooth to prevent excessive rope wear, with no sharp edges or abrupt corners around which the rope must pass.

In the preferred embodiment of the invention the base comprises a first plate which is flat in the region adjacent to said sheaves, the pivotable member abuts said first plate and carries a pair of sheave like projections, the member being pivotable about the axis of said first projection, and a second plate abuts the first sheave like projection and is pivotable about the axis thereof the second plate being adapted to cover the gap between the first and second projections when in a first pivotal position and to uncover the gap when in a second pivotal position. The first and second plates each include a hole at one extremity thereof for attachment to a harness, the hole in the second plate being aligned with the hole in the first plate when the second plate covers the gap between the pair of projections. Preferably the braking surface will be provided by a post extending from the first plate parallel to the axes of the pair of projections, and the second plate will also cover the gap between the second projection and the post when the attachment holes of the first and second plates are aligned.

BRIEF DESCRIPTION OF THE DRAWINGS

Embodiments of the invention will now be described in detail with reference to the accompanying drawings in which.

DESCRIPTION OF THE PREFERRED EMBODIMENTS

Figure 2:
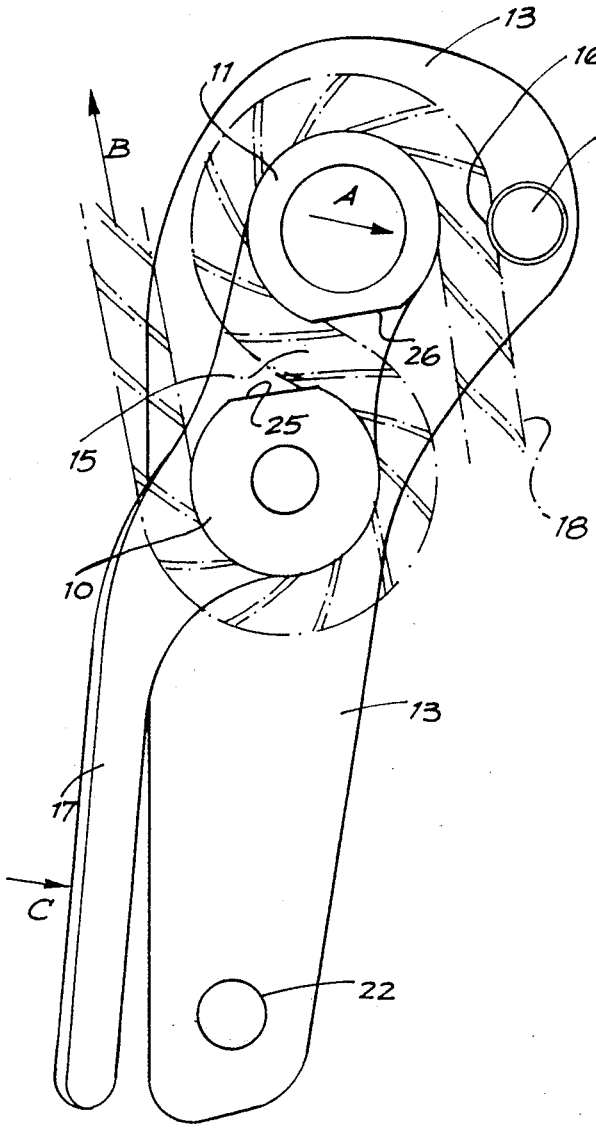
FIG. 2 illustrates the embodiment of FIG. 1 with the top plate removed to reveal the path of a rope through the descender.

Referring first to FIG. 2 the descender includes two sheaves 10 and 11 non-rotatably attached to a pivotal member 12. The member 12 is pivotably mounted to a base plate 13, the first sheave 10 being co-axial with the pivotal axis. A post 14 projects from the base plate 13 to provide a braking surface 16 such that when the second sheave 11 is pivoted in the direction A towards the post 14, the rope 15 is pressed between the sheave 11 and the braking surface 16. The force required to pivot the second sheave 11 towards the post 16 is provided by the frictional engagement of the rope 15 with the sheaves 10 and 11 as the rope travels in the direction B. Additional pivoting force is provided by tension on the tail of the rope 18, the tension in the tail being controlled by the person using the descender and being contributed to by the weight of the tail 18. The total pivotal force acting on the pivotal member 12 is given by the couple of the forces applied to the pivotal member by the two ends of the rope, this couple being applied about the pivotal axis of the pivotal member 12.

The pivotable member 12 extends away from the second sheave 11 to provide a lever handle 17 which, when moved in the direction C with regard to the base plate 13, reduces the braking force provided by the friction of the rope 15 with the sheaves 10 and 11 and the braking surface 16, until a state of minimum braking force is reached when the rope is no longer contacting the braking surface 16. It will be recognized, however, that even under the minimum braking situation described, the speed of travel of the rope 15 through the descender can be controlled by varying the tension on the tail 18 of the rope.

Figure 1:
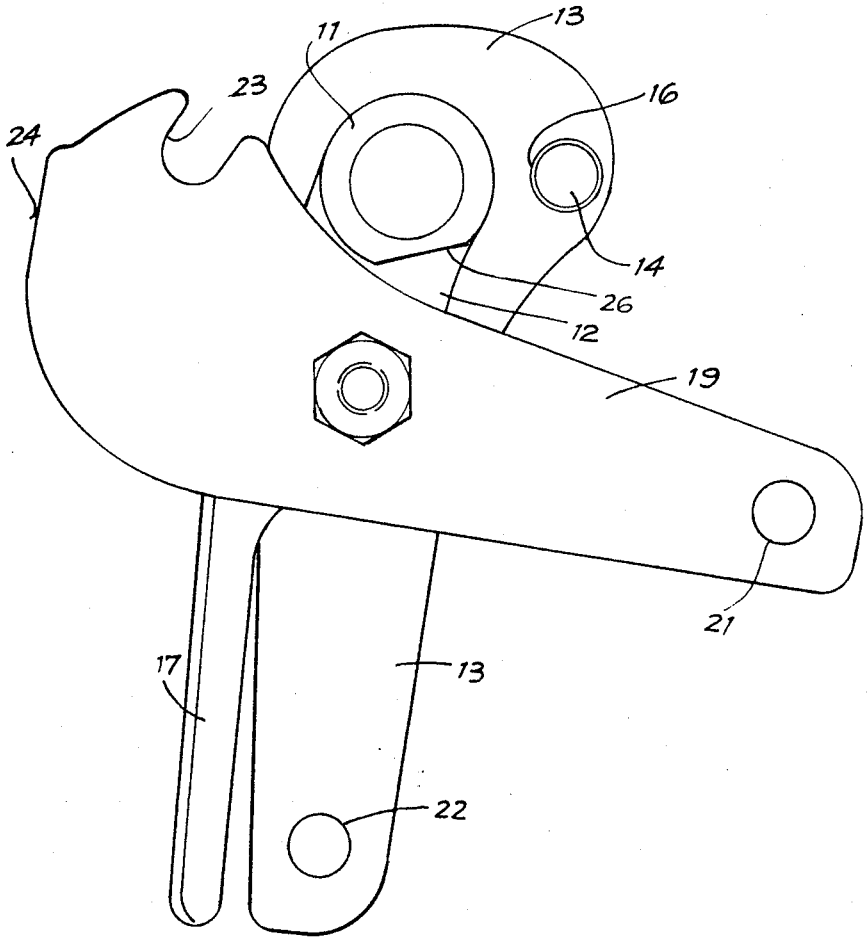
FIG. 1 illustrates a first embodiment of the present invention.

Turning to FIG. 1, a rope retention plate 19 pivotable about the same axis as the member 12 allows the rope to be inserted into and removed from the descender when in the open position shown. However, when pivoted to a closed position where the hole 21 in the retention plate 19 and hole 22 in the base plate 13 are aligned the retention plate 19 covers the gap between the two sheaves 10 and 11 and the gap between the second sheave 11 and the post 14, to prevent the rope from accidentally jumping out of the descender during the descent. When in the closed position a slot 23 in the retention plate 19 engages with a circumferential groove (not shown) in the post 14 to provide added support for the retention plate 19, thereby reducing any tendency for the plate 19 to twist due to side loading of the descender by the rope. The hole 22 in base plate 13 is used to attach the descender to a harness by means of a carabinier and the hole 21 in retention plate 19 is so positioned that it is aligned with the hole 22 when the retention plate is in the closed position, thereby allowing the carabinier to be inserted through both holes, ensuring that the retention plate 19 is securely held in the closed position during a descent.

Returning to FIG. 2, the sheaves 10 and 11 have their upper adajcent edges 25 and 26 cut away to allow the rope 15 to be easily inserted therebetween, the cut-away edges being slightly offset with regard to one another in order to reduce any tendency for the rope 15 to slip out under tension.

Figure 3:
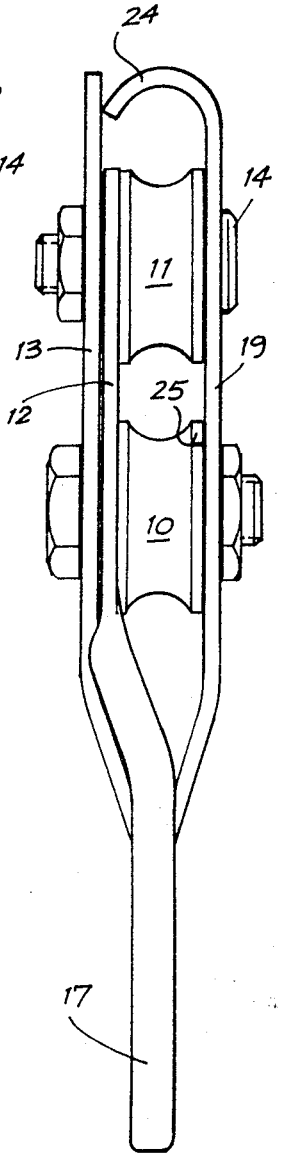
FIG. 3 illustrates the embodiment of FIG. 1 as viewed from one side.

Referring now to FIG. 3 the retention plate 19 also has a hooked end portion 24 which prevents the rope from jumping off the second sheave 11 and wrapping around the end portion of the descender when the retention plate 19 is in the closed position.

Referring now to FIGS. 4–7, a second embodiment of the invention is illustrated, wherein the pivotal member 32 is a cast part with bosses 30 and 31 and lever 17 forming integral parts of the casting. The pivotal member 32 is pivotably connected between a base plate 33 and a retention plate 39 by a bolt 58 and a threaded member 52, the bolt 58 having a threaded portion 57 extending through holes in the base plate 33, the pivotal member 32 and a retention plate 39, the hole in the pivotal member 32 passing through the boss 30, and the threaded member 52 including an internally threaded tubular portion 53 which co-operates with the threaded portion 57 of the bolt 58. A coil spring (not shown) is provided about the pivotal axis of the pivotal member 32 to bias the boss 31 away from the post 34. The fulcrum of the pivotal member 32 is made to be variable by the provision of a hexagonal insert 55 which is located in a suitably sized hexagonal opening 54 in the boss 30, the hexagonal insert 55 having an off center hole 56 through which the threaded portions 57 and 53 pass, the hole 56 defining the pivotal axis of the pivotal member 32 and the position of the pivotal axis being varied by rotating the hexagonal insert 55 to the desired position within the opening 54 during assembly of the descender. Variation of the pivotal axis alters the effective transverse distance between the pivotal axis of the pivotal member 32 and the point of application of the force in the upper rope portion on the first boss 30, without significantly altering the distance between the pivotal axis and the point of application of the force in the tail 18 of the rope on the second boss 31.

The method employed to achieve a transversely variable pivotal axis of the pivotal member 32 also involves some longitudinal movement of the axis and in view of this, the second boss 31 is provided with a peripheral portion 63 which is substantially straight, such that the angle of the pivotal member 32 with respect to the base plate 33 when the rope is wedged between the boss 31 and the braking surface 36 is substantially constant for varying pivotal axes.

The boss 31 also has a flattened face 46 which allows easy insertion of a rope between the bosses 30 and 31, the boss 30 being round, without a cut-away side, unlike the sheave 10 of the first embodiment.

Figure 4:
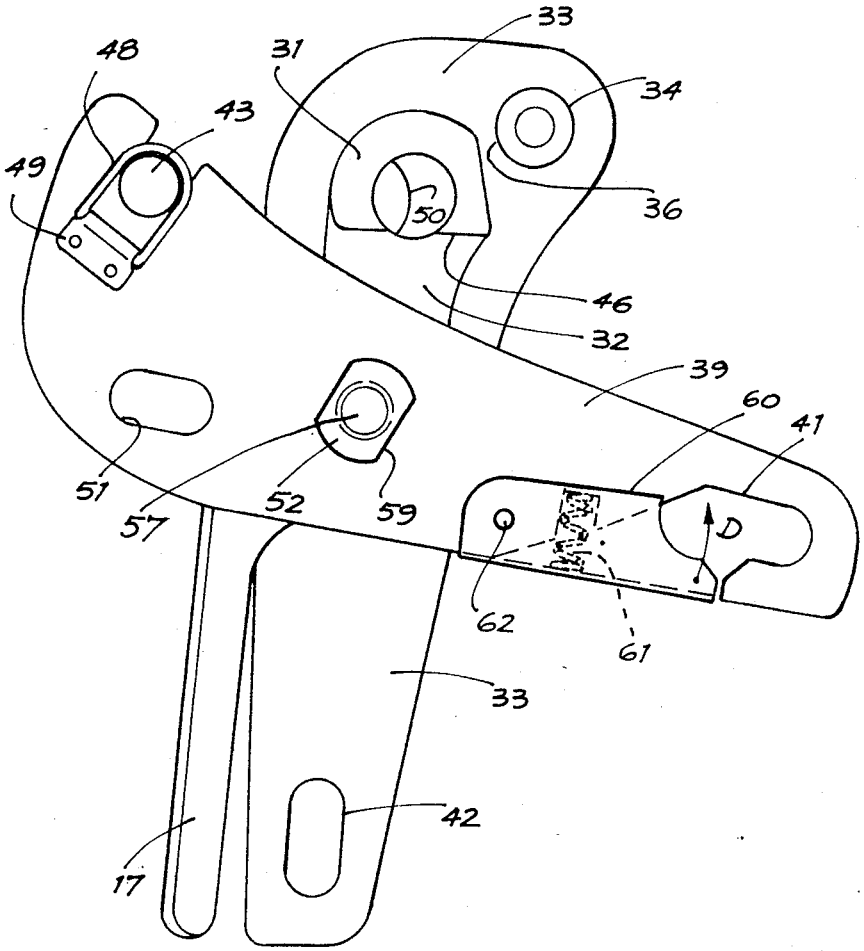
FIG. 4 illustrates a second embodiment of the invention from the top.
Figure 5:
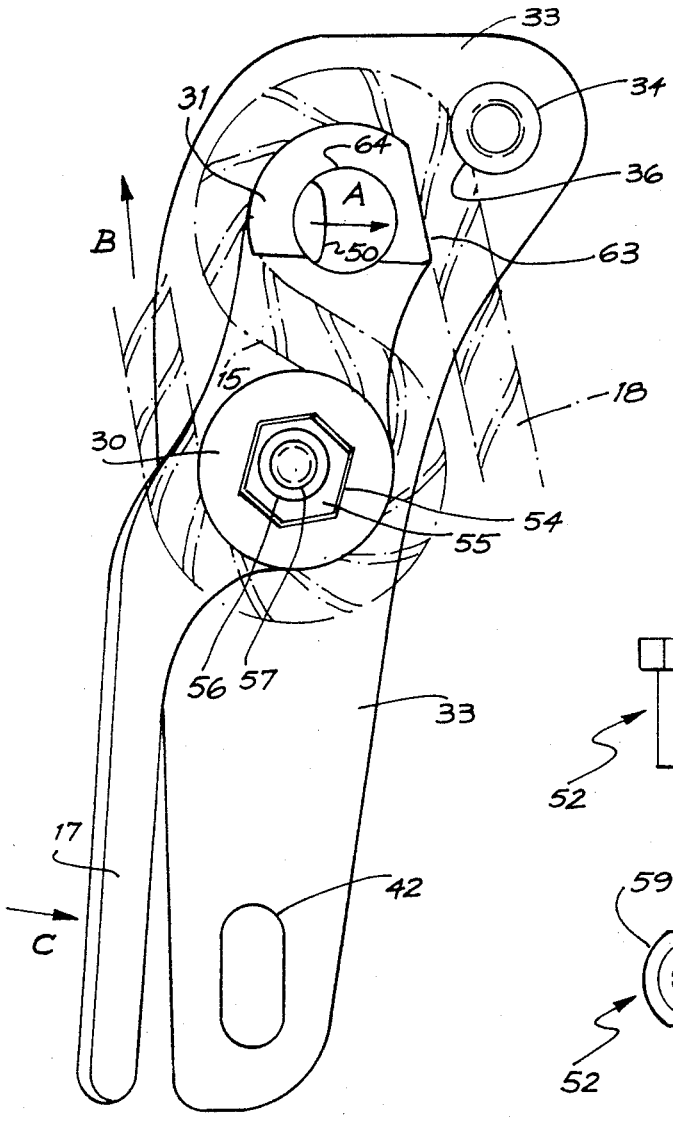
FIG. 5 illustrates the embodiment of FIG. 4 with the top removed.
Figure 6:
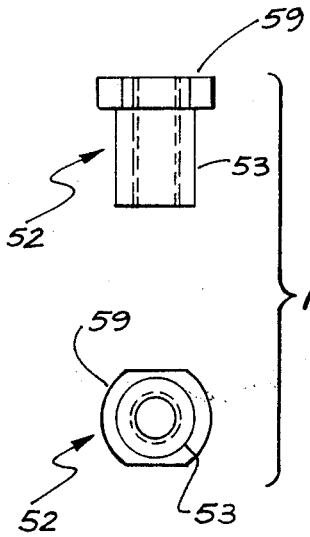
FIG. 6 illustrates a connecting member for the FIG. 4 embodiment, shown in plan and elevation.

The base plate 33 is provided with an elongated hole 42 by which the descender can be permanently connected to a harness during use, the connection being generally made by way of a carabinier. The retention plate 39 is provided with a slot 41 which opens through one side of the plate 39, this slot being closed off by a closure member 60 pivotably connected to the plate 39 by a rivet 62 and a spring 61 being provided to bias the closure member 60 to the closed position. To move the retention plate to the closed position, the closure member 60 is pivoted in direction D and the carabinier which is already connected through hole 42 is passed through the opening into the slot 41. The closure member 60 is then released to retain the carabinier in the slot 41. To reopen the descender, the closure member 60 is again depressed in the direction D and the carabinier removed from the slot 41 as the retention plate is pivoted to the open position (as shown in FIG. 4).

The base plate 33 and the retention plate 39 are also provided with holes 50 and 51 respectively such that the braking action of the descender may be inhibited by passing a carabinier or other suitable device through the hole 50, the opening 64 in the center of boss 31 and the hole 51 to hold the pivotal member 32 away from the braking surface 36 of the post 34.

An optional clip can also be provided on the retention plate 39 to maintain the descender in the closed position. This clip comprises a D-shaped member 48 pivotably connected to the retention plate 39 by a hinge 49, the D-shaped member being adapted to engage the post 34 when the descender is closed. This additional clip is generally not required for the single rope embodiment of the invention shown in side view of FIG. 7 but is desirable in the double rope embodiment of FIG. 8.

Figure 7:
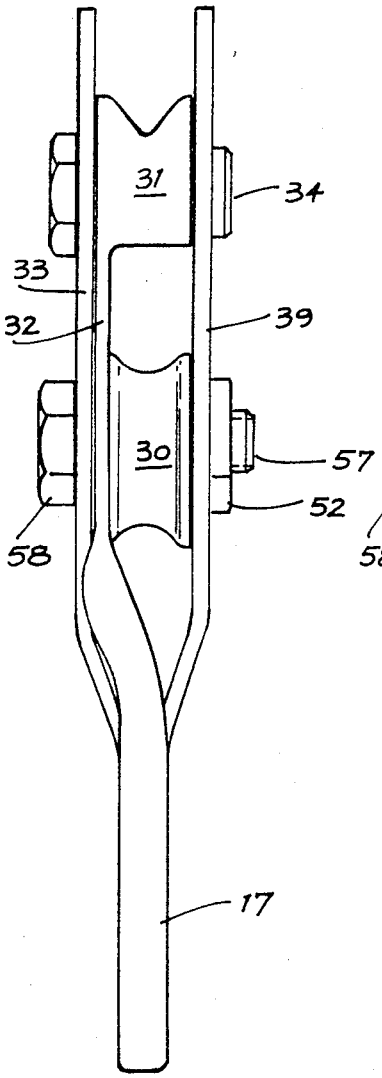
FIG. 7 illustrates the embodiment of FIG. 4 when viewed from the side.
Figure 8:
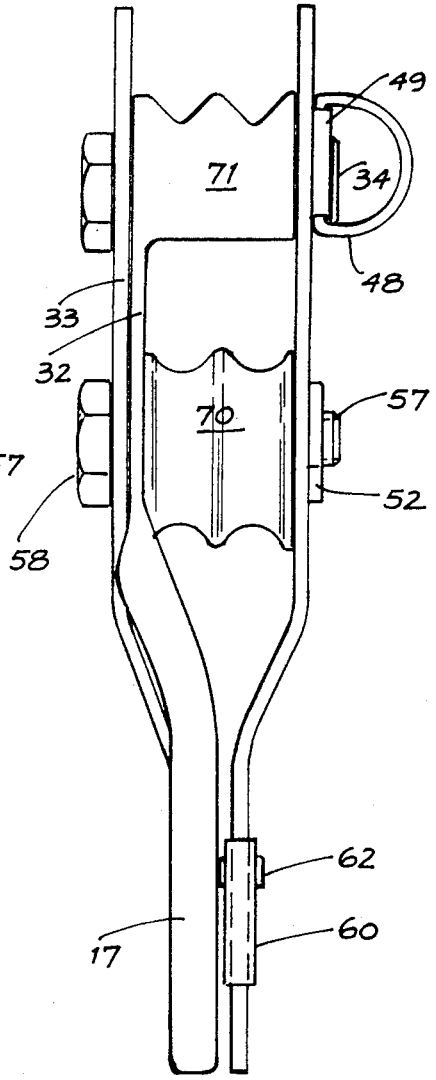
FIG. 8 illustrates a side view of a third embodiment of the invention which is adapted to accept a double rope.

Referring to FIG. 8, the double rope embodiment illustrated is substantially the same as the embodiment described with reference to FIGS. 4–7 except that the bosses 70 and 71 are approximately double t height of the bosses 30 and 31 of the single rope embodiment. Similarly, the bolt 58, threaded member 52 and braking post 34 must be longer in the double rope embodiment, and as previously stated, the optional clip 48, 49 is desirable on this embodiment.

The double rope embodiment of FIG. 8 is particularly useful for mountain climbers, who after descending one section of mountain will want to retrieve their ropes before descending the next section. This is achieved by descending a doubled rope and then pulling one end of the doubled rope to retrieve it.

As seen in FIGS. 7 and 8, it is preferred that bosses 31 and 71 have grooves which are substantially V-shaped rather than rounded, as there is a tendency for the rope to be excessively flattened under the braking surface 16, 36 when rounded grooves are employed. Grooves on the lower bosses 30 and 70 remain rounded, however, to obtain a better distribution of frictional forces.

The use of a V-shaped groove on bosses 31 and 71 also improves the operation of the descender when used with thinner ropes, making it possible to use the descender with a length of thin rope which can be easily stored and carried for use in emergency situations. It is possible to produce embodiments of the present invention which will work with a full range of rope sizes, including ropes having a diameter as small as 6–7 millimeters, whereas prior art descenders are generally not suitable for use with such small ropes. Typically ropes used in descenders are in the range of 11–12 millimeters diameter.

Although the description of the embodiments illustrated in FIGS. 4–8 refers to the pivotal member as a cast part wherein the bosses 30, 70 and 31, 71 and the lever 17 are cast integrally with the pivotal member 32, production may be simplified by casting the lever and pivotal member 32 and then attaching the bosses 30, 70 and 31, 71 which can be fabricated by turning or any other suitable technique.

It will be recognized by persons skilled in the art that numerous variations and modifications may be made to the invention as described above without departing from the spirit or scope of the invention as broadly described.

I claim:

1. A descender for use in abseils, in use the descender being connected between a rope and a harness, the descender comprising: a base; a pivotal member mounted on the base about a pivotal axis extending perpendicular thereto; first and second projections for engaging the rope, the projections extending perpendicularly from the pivotable member; means mounted on the base for connection to the harness; wherein the first projection is disposed about said axis and the second projection projects from said pivotable member in a direction substantially parallel to said axis, the second projection being located substantially on the opposite side of the first projection with respect to the means for connection of the base to the harness;

a braking surface on a stopmember projecting from said base and located adjacent to the second projection; wherein when the rope passes around the first projection, between the first and second projections, around the second projection and between the second projection and the braking surface, the rope is pressed between the second projection and the braking surface when the second projection is pivoted toward the braking surface; and handle means extending from said pivotal member in a plane substantially perpendicular to the axis, said handle means being positioned such that upon urging the handle in one direction the second projection moves away from the stop member allowing the rope to slip through the descender.

2. The descender of claim 1, wherein said base comprises an elongate metal plate having first and second ends, said plate being substantially flat at least between the first end thereof from which said braking surface projects and said pivotal axis of the pivotable member.

3. The descender of claim 2, further including a retention plate for preventing disengagement of said rope from the descender when in use, said retention plate comprising an elongate metal plate substantially parallel to said base and located on the opposite side of the pivotable member with respect to said base, the retention plate having first and second ends and being pivotable about the pivotal axis of the pivotable member between an open position and a closed position, means for engaging said braking surface being located at the first end of the retention plate and said retention plate being substantially flat between said engaging means and said pivotal axis.

4. A descender of claim 3, wherein the retention plate has edges which converge towards the second end thereof.

5. The descender according to claim 4, wherein said connection means includes a hole adjacent the second end of the base.

6. The descender of claim 5, wherein said hole in the second end of the base is elongate, said retention plate has an opening adjacent to the hole in the base when the retention plate is pivoted to align the second end thereof with the second end of the base and said opening extends through the side of the retention plate and is closed by a pivotable closure member which closure member is biased into a closed position.

7. The descender according to claim 3, wherein means are provided to restrict the movement of the pivotal member.

8. The descender of claim 7, said means to restrict movement comprises a pin and holes in said base and said retention plate, said holes being aligned to co-operate with a hole through said second projection when said second projection is in a position remote from the braking surface, whereby the pin is placed through said holes to retain the second projection in said remote position.

9. The descender according to claim 1, wherein the pivotal member, the two projections and the handle means are cast in one piece.

10. The descender according to claim 1, wherein the pivotal member and the handle means are cast in one piece and the projections are fabricated separately and attached to the pivotal member.

11. The descender according to claim 1, wherein the braking surface is a surface of a post extending perpendicularly from the base.

12. The descender according to claim 1, wherein the position of the pivotal axis of the pivotal member is variable.

13. The descender as claimed in claim 12, wherein the pivotal axis of the pivotal member is defined by a hole passing through an insert located in said first projection, said hole being off center in said insert and said insert having a plurality of discrete rotational positions in said first projection.

* * * * *